US008526153B2

(12) United States Patent
Freimuth et al.

(10) Patent No.: US 8,526,153 B2
(45) Date of Patent: Sep. 3, 2013

(54) AUXILIARY TRIPPING UNIT FOR A CIRCUIT BREAKER

(75) Inventors: Michael Freimuth, Hirschau (DE); Jürgen Renner, Trasslberg (DE); Andreas Späth, München (DE)

(73) Assignee: Siemens Aktiengesellschaft, Munich (DE)

( * ) Notice: Subject to any disclaimer, the term of this patent is extended or adjusted under 35 U.S.C. 154(b) by 593 days.

(21) Appl. No.: 12/778,163

(22) Filed: May 12, 2010

(65) Prior Publication Data

US 2010/0288611 A1 Nov. 18, 2010

(30) Foreign Application Priority Data

May 13, 2009 (DE) ..... 10 2009 021 754

(51) Int. Cl.
*H01H 73/00* (2006.01)
*H01H 9/26* (2006.01)

(52) U.S. Cl.
USPC ..... 361/115; 361/102; 200/50.32; 200/50.34

(58) Field of Classification Search
USPC ..... 361/115, 102; 200/50.32, 50.34
See application file for complete search history.

(56) References Cited

U.S. PATENT DOCUMENTS 3,919,674 A * 11/1975 Acampora et al. ..... 335/20
4,001,742 A 1/1977 Jencks et al.
4,097,831 A 6/1978 Jencks et al.
4,114,005 A * 9/1978 Maier et al. ..... 200/400
4,286,242 A * 8/1981 Mrenna et al. ..... 335/160
6,933,811 B2 8/2005 Enokihara et al.

FOREIGN PATENT DOCUMENTS

| | | |
|---|---|---|
| CN | 1241291 | 1/2000 |
| DE | 19703793 | 8/1998 |
| DE | 102009007586 | 8/2010 |
| EP | 1 128 412 | 8/2001 |
| JP | 2719436 | 2/1998 |

OTHER PUBLICATIONS

Office Action for German patent application No. 10 2009 021 754.1 dated Jun. 22, 2011.

Office Action and Search Report for corresponding Chinese patent application No. 201010180312.7 mailed Oct. 12, 2012.

* cited by examiner

*Primary Examiner* — Rexford Barnie
*Assistant Examiner* — Zeev V Kitov
(74) *Attorney, Agent, or Firm* — Harness, Dickey & Pierce, P.L.C.

(57) ABSTRACT

In an undervoltage tripping unit of at least one embodiment, an armature acts on a tripping slide via a drum. During tripping, an auxiliary switch is closed. In order to reset the undervoltage tripping unit after tripping, a latching mechanism of an associated circuit breaker acts on the drum via a driver bolt. At the same time, a projecting element is formed on the drum and closes the auxiliary switch when the drum is rotated back. The auxiliary switch therefore need not itself be directly coupled to the latching mechanism.

20 Claims, 2 Drawing Sheets

AUXILIARY TRIPPING UNIT FOR A CIRCUIT BREAKER

PRIORITY STATEMENT

The present application hereby claims priority under 35 U.S.C. §119 on German patent application number DE 10 2009 021 754.1 filed May 13, 2009, the entire contents of which are hereby incorporated herein by reference.

FIELD

At least one embodiment of the invention generally relates to an auxiliary tripping unit for a circuit breaker, and in particular, for an under-voltage tripping unit.

BACKGROUND

The purpose of circuit breakers is to decouple a number of loads from a voltage supply system when a specific disturbance occurs. The classic disturbance is the occurrence of a short-circuit current, and the circuit breakers are conventionally designed to move a switching element in the event of a short-circuit current such as this, and thus to disconnect the connection between the loads and the power supply system.

However, the aim now is to disconnect loads in the power supply system in this way in other situations, as well. In particular, when disconnection of the power supply system from the loads in the event of an over voltage or an under-voltage in the power supply system is desired. Auxiliary tripping units are used to provide a functionality for this purpose. Such units are typically in the form of a withdrawable unit, which can be pushed into a withdrawable unit compartment in the circuit breaker. Part of the tripping mechanism in a circuit breaker is conventionally a latching mechanism. The auxiliary tripping units can act on this particular latching mechanism, thus producing the circuit breaker disconnection process. For this purpose, it is equipped with a tripping element, for example a plunger. The tripping element, that is to say in particular the plunger, is retracted in an untripped state. The tripping element moves out of a housing of the auxiliary tripping unit for tripping.

After tripping, it must be possible to reset the system. A circuit breaker has a handle for resetting, which acts on the latching mechanism. This handle is also used to reset the auxiliary tripping unit. It is therefore normal for the latching mechanism of the circuit breaker to act indirectly on the tripping element when the circuit breaker handle is operated.

There is a chain of action in an auxiliary tripping unit: There are monitoring means which identify tripping, in particular by monitoring the voltage and thus identify that a voltage threshold value has been overshot or undershot. There is an armature which can be moved by movement means, and these movement means are driven by the monitoring means when tripping occurs. The armature typically does not act directly on the tripping element, but is coupled to it via a moving body. One reason for this, inter alia, is that it is easier to reset the tripping element as well as the armature via the moving body.

SUMMARY

In at least one embodiment, at least one coupling device is/are arranged on a moving body, and the moving body therefore includes such at least one coupling device, with these coupling devices allowing action by the latching mechanism, specifically actually for resetting. The action comprises a movement being applied to the moving body and therefore actually also to the tripping element that is coupled to it, with the movement being governed (predefined) by the design configuration.

In the case of auxiliary tripping units, the voltage is monitored by at least one monitoring device which require(s) electrical power to operate them. For this reason, auxiliary tripping units such as these have connections for application of an external voltage, via which such electrical power is provided. There is now a requirement for some applications for the applied voltage to be decoupled during tripping. Such decoupling can be carried out using simple switches. These are referred to as "auxiliary switches".

In an auxiliary tripping unit, auxiliary switches such as these are arranged behind the voltage connections for the voltage for operating the monitoring device(s). Auxiliary tripping units have at least one auxiliary switch, and in general even one specific auxiliary switch for each voltage connection. When the voltage is decoupled during tripping, it must also be reconnected again when the circuit breaker is reset. There are difficulties associated with this: in previous solutions, the resetting of the latching mechanism via the handle of the circuit breaker is used in the same way as for resetting the tripping element with the moving body and the armature.

In order to reset the auxiliary switches, at least one coupling device is provided at a different point, specifically in the area of the auxiliary switches, such that the latching mechanism can directly close those auxiliary switches which have previously been opened in order to decouple the voltage, via these at least one coupling device(s). Since the coupling device(s) must therefore be provided for the tripping element and the associated mechanism on the one hand and coupling device(s) must be provided for the auxiliary switches, this necessitates a complicated design, and this even affects the latching mechanism itself as well. In particular, restrictions exist with regard to the placing of the auxiliary switches, because they must be arranged together with the associated coupling means on that side of the auxiliary tripping unit which faces the latching mechanism. This also applies to the tripping mechanism with the armature, the moving body and the tripping element.

At least one embodiment of the invention is directed to indicating a way in which an auxiliary tripping unit for a circuit breaker can be designed without excessive design constraints despite the presence of auxiliary switches, such that it is also possible to take account of other secondary conditions, rather than the requirement for resetting, in the design of the auxiliary tripping unit.

According to least one embodiment of the invention, the moving body, which is coupled to the tripping element, has at least one device for acting on the auxiliary switch, and by which the auxiliary switch is closed when a movement is applied to the moving body by a latching mechanism.

Instead of the latching mechanism directly closing the auxiliary switch as in the past, in the case of least one embodiment of the invention, the auxiliary switch is closed indirectly via the moving body. The moving body is moved by the latching mechanism in any case during the resetting process.

The at least one coupling device provided for this purpose on the moving body can then remain the only coupling means, and no separate coupling means need be provided for the auxiliary switches, as in the prior art. This therefore results in greater freedom for the design of the auxiliary tripping unit, matching a known design of a latching mechanism. In particular, there are also no restrictions affecting the design of the latching mechanism itself, because of the presence of the auxiliary switch.

In principle, the moving body could carry out a linear movement, but it has been found to be advantageous for the moving body to be rotatable. In the case of a rotatable body, suitable devices are provided at any desired distances from a rotation axis and at any desired angular positions, and interact with other components. The system operates in a particularly stable form if the moving body can rotate about a stationary axis.

In the case of a rotatable body, the at least one coupling device can simply comprise a bolt, or may be in the form of a bolt. For definition of a fixed rotation axis with respect to the rotatable body, a bolt such as this can be arranged at a distance from the rotation axis, and can extend parallel to it. The moving body can then easily be rotated by action on the bolt, specifically by the latching mechanism. The bolt is therefore the point of action for exerting a torque.

When the coupling devices are arranged on one side of the moving body, it is advantageous to provide the at least one device for acting on the auxiliary switch on the side of the rotatable body facing away from this side. In precisely the same way as the preferred provision of a bolt, a projecting element can be provided as the means for action. The projecting element may itself be in the form of a cylindrical bolt but may also be in a form which is not quite so simple, in order, together with the rest of the rotatable body, to have precisely defined actions during its rotation, specifically on the auxiliary switch, or on a mechanism for closing the auxiliary switch.

If the device for action, specifically in particular the projecting element, are arranged on the side of the moving body facing away from the coupling device(s), and therefore facing away from the latching mechanism, the auxiliary switch can be accommodated on that side of the auxiliary tripping unit which does not interact with the latching mechanism. The lines which are interrupted by the auxiliary switch can also be accommodated on this side, with the auxiliary switch. Finally, various monitoring means which are supplied with electrical power via these lines can also actually be arranged on this side as well. None of these components therefore have any adverse effect, or only a minor adverse effect, on the design of the auxiliary tripping unit.

The tripping unit is intended to preferably move in a more or less linear form. In order to ensure that this is possible for coupling to a rotatable body, this coupling should allow the tripping element to itself move with respect to the rotatable body, in particular to allow it to tilt. This is the case when the tripping element is suspended on the body or is hooked into the body beyond the rotation axis. For this purpose, the rotatable body may have a rod which extends parallel to the rotation axis of the rotatable body. The fundamental principle of coupling the tripping element to the rotatable body is similar to the attachment of a connecting rod to a wheel although, in the present case, the rotatable body has to move through only small rotation angles between the untripped state and the tripped state. As in the case of a connecting rod, an element is, in particular, in the form of a piston which moves in a straight line, the element in the present case may be a tripping plunger which moves more or less in a straight line.

Auxiliary tripping units typically have a force store which moves in order to trip the moving body and thus pushes the tripping element out of the housing of the auxiliary tripping unit. If the body can rotate, a spring cannot be supported in a stable form on it directly, because the bearing for the spring rotates with the body. In order nevertheless to allow spring force to act in a stable manner on the rotatable body, a holder is preferably formed on or attached to the rotatable body, and a receptacle is provided in the holder. If a spiral spring engages in the receptacle, the spiral spring cannot slide off during rotation of the rotatable body, but is held in a stable form. It can then optimally transmit force to the rotatable body.

As stated above, the tripping process is initiated by the movement of an armature. The actual tripping process is carried out by spring force. It is therefore necessary to ensure in the untripped state with the armature blocks the movement of the rotatable body, and movement must then be enabled in the event of tripping. The coupling of the armature to the rotatable body can be solved by the armature having a pin which engages in a cutout in the body. The cutout should provide a shoulder, with a relatively narrow guide being connected to this shoulder.

The arrangement should then be as follows: when the auxiliary tripping unit is in the untripped state, the pin which is arranged on the armature is supported on the shoulder. The force store which is generally provided then presses on the body such that the shoulder presses against the pin, and thus prevents movement of the body. The at least one device for movement should then provide a movement of the armature such that the movement of the armature results in the pin being moved away from the shoulder, subsequently allowing rotation of the rotatable body, because the guide is provided. The pin can then be guided in the guide during the rotation of the rotatable body which follows the movement of the armature, until it reaches the end of the guide. The movement of the rotatable body is then stopped.

BRIEF DESCRIPTION OF THE DRAWINGS

One preferred embodiment of the invention will be described in the following text with reference to the drawings, in which.

DETAILED DESCRIPTION OF THE EXAMPLE EMBODIMENTS

Figure 1:
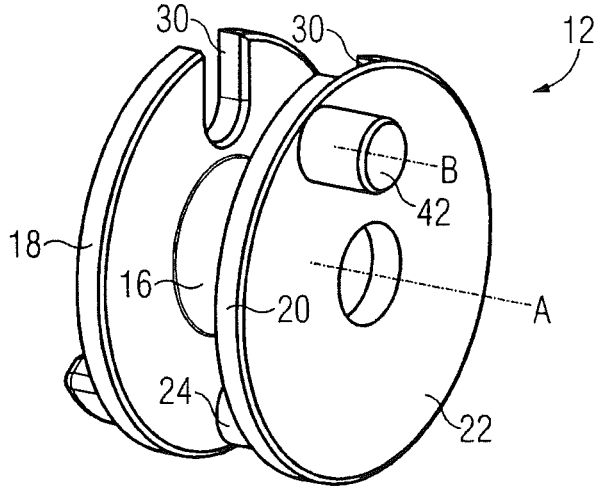
FIG. 1 shows a perspective illustration of a drum which is used in an undervoltage tripping unit according to an embodiment of the invention.
Figure 2:
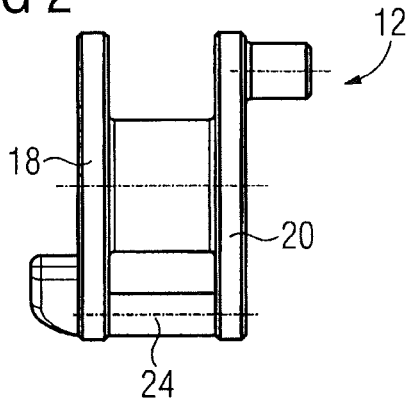
FIG. 2 shows a front view of the drum shown in FIG. 1.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Monitoring devices in an undervoltage tripping unit monitor whether a voltage applied between two potential points is below a threshold value. If this is the case, the monitoring devices cause an armature to move, which acts indirectly on the tripping element in order to move this tripping element out of the housing and of the undervoltage tripping unit, acting on a latching mechanism of a circuit breaker, to which the undervoltage tripping unit belongs.

Figure 3:
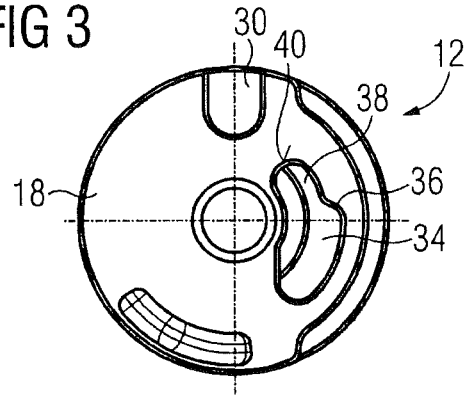
FIG. 3 shows a side view of the drum shown in FIG. 1, with a cover plate omitted.
Figure 4:
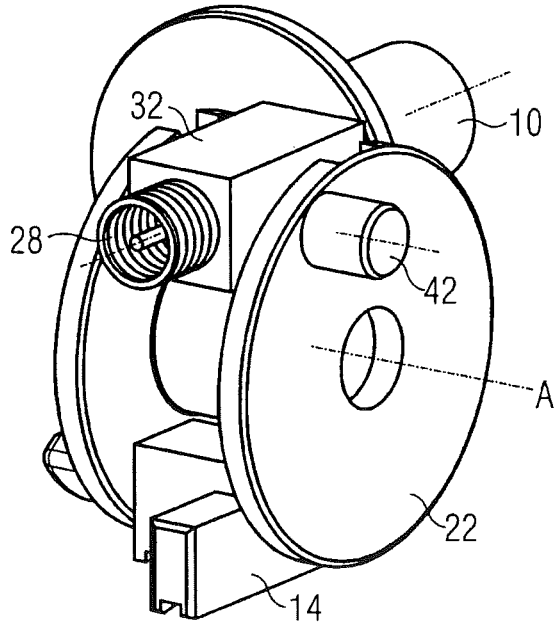
FIG. 4 shows a perspective view of an arrangement with the drum shown in FIG. 1 and with further elements coupled to it.

In the present case, an armature 10 is coupled to a tripping slide 14 via a drum 12 which can rotate about a rotation axis A. The drum 12 has a central, in the present case round, tube 16, which can be plugged onto a rod (not shown) as a bearing, such that it can rotate about this rod. Disks 18, 20 which are annular are arranged on both sides on the tube 16, and their external diameters are larger than the diameter of the tube 16. The disk 18 illustrated in detail in FIG. 3 is covered by an annular cover plate 22.

Figure 5:
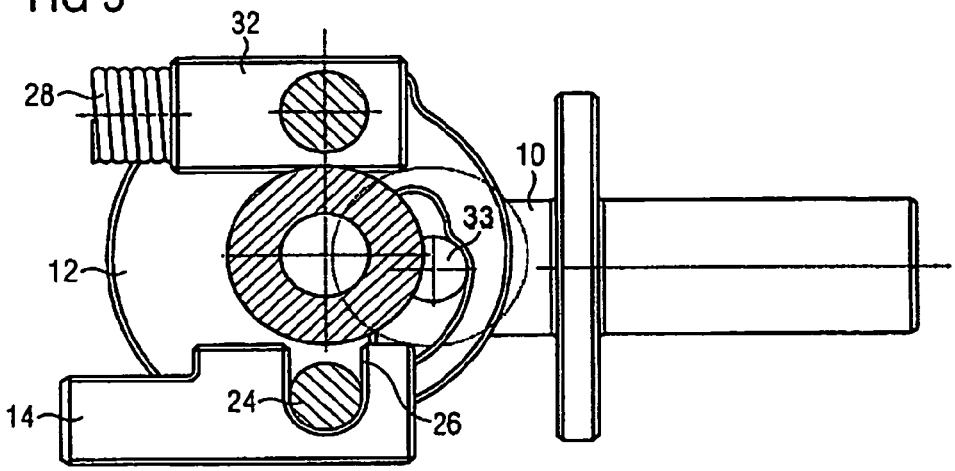
FIG. 5 shows an internal view from the side of the arrangement shown in FIG. 4, with components at the side being omitted and, FIG. 6 shows a front section view of the arrangement shown in FIG. 4, together with an outline illustration of an auxiliary switch for the undervoltage tripping unit according to an embodiment of the invention.

The two disks 18, 20 are connected to one another not only radially as far as possible outward via the tube 16 but also via a rod 24 having a circular cross section. The tripping slide 14 has a cutout 26 (FIG. 5) and is hooked by means of this cutout 26 into the drum 12 such that the rod 24 passes through the cutout 26. When the drum 12 rotates, the rod 24 moves the tripping slide 14, to the left in FIG. 5. In this case, the rod 24 can move backward and forward in the cutout 26 (this is an up and down movement when illustrated as shown in FIG. 5). The tripping slide is therefore not tilted, but is moved in a straight line.

In order to ensure that rotation of the drum 12 is initiated during tripping, a spring is provided, in the present case a spiral spring 28. Cutout 30 is provided for the coupling of the spring in the two disks 18 and 20 of the drum 12, with a holder 32 being hooked into the cutouts 30. The holder 32 itself has a receptacle with a circular cross section, into which the spiral spring 28 fits precisely. The spiral spring 28 presses against the end of this receptacle and therefore against the holder 32, and this force is transmitted to the disks 18 and 20 thus resulting in a torque being exerted on the drum 12. During rotation of the drum 12, the holder 32 can rotate as an entity with respect to the drum 12 and can thus be adjusted in each case beyond a range of rotation angles in such a way that the spiral spring 28 need not be significantly bent.

In the untripped state, the spiral spring 28 should be preloaded and should prevent rotation of the drum 12. The drum 12 must then be released for tripping. The tripping process is carried out via a movement of the armature 10. The armature 10 has a pin 33 which engages in a cutout 34 (see FIG. 3) in the drum 12. In the untripped state, the pin 33 is supported on a shoulder 36 which is provided by the shape of the cutout 34. The armature 10 is moved during tripping, to the left in the illustration shown in FIG. 5. The pin 33 is then released from the shoulder 36. A guide 38 is adjacent to the shoulder 36. While the spring 28 presses against the holder 32 and therefore against the drum 12, but the drum 12 cannot move, because the shoulder 36 is pressed against the pin 33, the drum 12 can be rotated as soon as the pin 33 no longer blocks the shoulder 36: specifically, in this case, the pin 33 is moved along the guide 38. The rotation is not stopped again until the drum 12 has moved so far that the end 40 reaches the pin 33. During the rotation, the load on the spiral spring 28 is released, and the tripping slide 14 is moved as described above.

After tripping, the entire system must be reset at some time, that is to say both the circuit breaker and the undervoltage tripping unit. The resetting process is carried out by operating a handle in the circuit breaker, which acts on the circuit breaker latching mechanism. In the present case, the undervoltage tripping unit is also preset by operation of a handle such as this.

A cylindrical driver bolt 42 is for this purpose arranged on the plate 22, with the axis of symmetry B of the cylinder being parallel to the rotation axis A of the drum 12, and in the present case being as far away from it as possible. The driver bolt 42 projects out of the housing of the undervoltage tripping unit in a manner which is known per se and will therefore not be explained here by a drawing, specifically into the area of the latching mechanism of the circuit breaker to which the undervoltage tripping unit belongs. During the resetting of the latching mechanism, there are then elements thereof which act on the driver bolt 42 and result in it being moved. The drum 12 is then rotated against the force of the spiral spring 28, with the armature 10 being acted on at the same time and with the armature 10 being pushed back thus finally resulting once again in the situation illustrated in FIG. 5, in which the pin 33 prevents the drum 12 from rotating back on its own in the tripped state.

Figure 6:
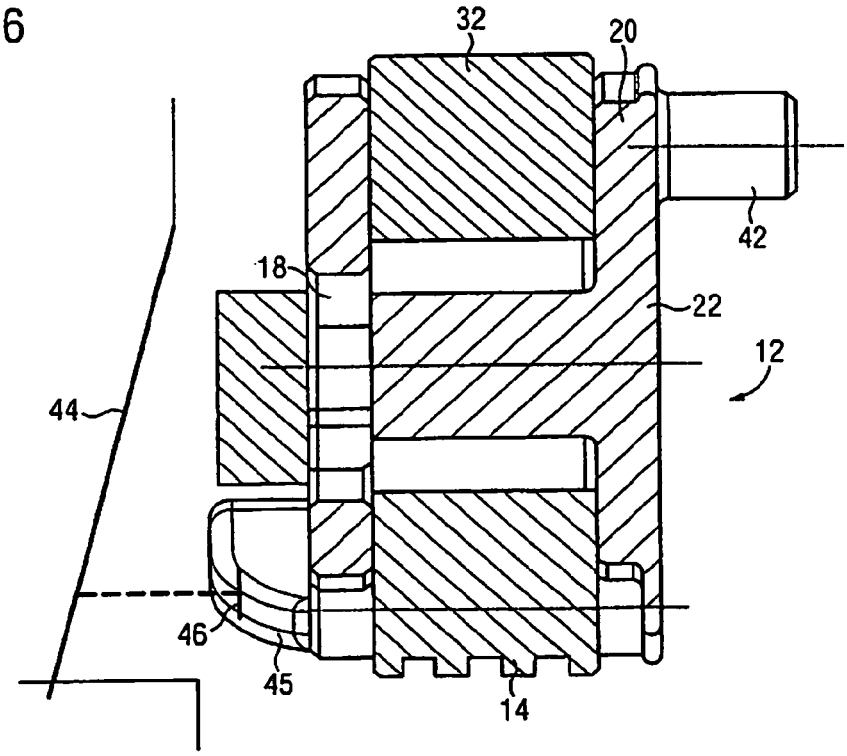

In the present case, an auxiliary switch is provided in the undervoltage tripping unit, and this is shown schematically in FIG. 6, where it is annotated 44. During tripping of the undervoltage tripping unit, the auxiliary switch 44 is opened in a manner known per se, in order that the voltage which is provided for operation of the monitoring device and possibly further device is not present all the time in the undervoltage tripping unit, for as long as it is in the untripped state. The switch 44 is also intended to be closed again during resetting.

In the present case, this is done indirectly via the drum 12: a projection 45, which projects from the plate 18, is attached to or formed on the plate 18 and has the function of an auxiliary switch operator. As illustrated symbolically in FIG. 6, a chamfer is provided on the projection 45 and slides along an element 46, which is operated in the switch 44, during rotation of the drum 12, thus resulting in the auxiliary switch 44 being closed when the drum 12 is moved to its untripped angular position. The auxiliary switch 44 can thus be arranged on the side of the undervoltage tripping unit facing away from the latching mechanism, where sufficient space is available. The undervoltage tripping unit can therefore be designed with freedom. With the driver bolt 42, there is only a single coupling device, via which a latching mechanism carries out a resetting process. There is no need for a second such coupling device.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An auxiliary tripping unit for a circuit breaker, comprising:

a tripping element to act on a latching mechanism, the latching mechanism being arranged outside the auxiliary tripping unit of the circuit breaker;

a moving body, coupled to the tripping element;

at least one coupling device, via which a movement is applicable to the moving body and thus to the tripping element; and at least one auxiliary switch to decouple a voltage applied externally to the auxiliary tripping unit, the moving body including at least one device to act on the at least one auxiliary switch and by which the at least one auxiliary switch is closed when a movement is applied to the moving body by the latching mechanism.

2. The auxiliary tripping unit as claimed in claim 1, wherein the moving body is rotatable.

3. The auxiliary tripping unit as claimed in claim 2, wherein the at least one coupling device comprises a bolt.

4. An auxiliary tripping unit for a circuit breaker, comprising:

a tripping element to act on a latching mechanism, the latching mechanism being arranged outside the auxiliary tripping unit of the circuit breaker;

a moving body, coupled to the tripping element;

at least one coupling device, via which a movement is applicable to the moving body and thus to the tripping element; and at least one auxiliary switch to decouple a voltage applied externally to the auxiliary tripping unit, the moving body including at least one device to act on the at least one auxiliary switch and by which the at least one auxiliary switch is closed when a movement is applied to the moving body by the latching mechanism, wherein the moving body is rotatable, the at least one coupling device comprises a bolt, and a projecting element is provided on a side of the rotatable body facing away from the bolt, as the at least one device to act on the auxiliary switch.

5. An auxiliary tripping unit for a circuit breaker, comprising:

a tripping element to act on a latching mechanism, the latching mechanism being arranged outside the auxiliary tripping unit of the circuit breaker;

a moving body, coupled to the tripping element;

at least one coupling device, via which a movement is applicable to the moving body and thus to the tripping element; and at least one auxiliary switch to decouple a voltage applied externally to the auxiliary tripping unit, the moving body including at least one device to act on the at least one auxiliary switch and by which the at least one auxiliary switch is closed when a movement is applied to the moving body by the latching mechanism, wherein the moving body is rotatable, and the rotatable body comprises a rod which extends parallel to a rotation axis of the rotatable body, and wherein the tripping element is suspended on or in the rotatable body, on the rod.

6. The auxiliary tripping unit as claimed in claim 2, wherein a holder, including a receptacle in which a spiral spring engages, is formed on, attached to or suspended on the rotatable body.

7. An auxiliary tripping unit for a circuit breaker, comprising:

a tripping element to act on a latching mechanism, the latching mechanism being arranged outside the auxiliary tripping unit of the circuit breaker;

a moving body, coupled to the tripping element;

at least one coupling device, via which a movement is applicable to the moving body and thus to the tripping element;

at least one auxiliary switch to decouple a voltage applied externally to the auxiliary tripping unit, the moving body including at least one device to act on the at least one auxiliary switch and by which the at least one auxiliary switch is closed when a movement is applied to the moving body by the latching mechanism, wherein the moving body is rotatable; and an armature to act on the rotatable body, wherein a cutout is formed on the rotatable body, wherein in the cutout, a pin, arranged on the armature, engages, wherein, when the auxiliary tripping unit is not in a tripped state, the pin is supported on a shoulder and devices for moving the armature are designed to move the shoulder to produce a tripped state, such that the pin is moved away from the shoulder, with the cutout including a guide, in which the pin is guided during subsequent rotation of the body.

8. The auxiliary tripping unit as claimed in claim 1, wherein the auxiliary tripping unit is an undervoltage tripping unit for a circuit breaker.

9. The auxiliary tripping unit as claimed in claim 2, wherein the moving body is rotatable about a stationary axis.

10. The auxiliary tripping unit as claimed in claim 9, wherein the at least one coupling device comprises a bolt which extends parallel to the rotation axis of the rotatable body.

11. The auxiliary tripping unit as claimed in claim 10, wherein a projecting element is provided on a side of the rotatable body facing away from the bolt, as the at least one device to act on the auxiliary switch.

12. The auxiliary tripping unit as claimed in claim 4, wherein a holder, including a receptacle in which a spiral spring engages, is formed on, attached to or suspended on the rotatable body.

13. The auxiliary tripping unit as claimed in claim 4, further comprising:

an armature to act on the rotatable body, wherein a cutout is formed on the rotatable body, wherein in the cutout, a pin, arranged on the armature, engages, wherein, when the auxiliary tripping unit is not in a tripped state, the pin is supported on a shoulder and devices for moving the armature are designed to move the shoulder to produce a tripped state, such that the pin is moved away from the shoulder, with the cutout including a guide, in which the pin is guided during subsequent rotation of the body.

14. The auxiliary tripping unit as claimed in claim 4, wherein the moving body is rotatable about a stationary axis.

15. The auxiliary tripping unit as claimed in claim 14, wherein the at least one coupling device comprises a bolt which extends parallel to the rotation axis of the rotatable body.

16. The auxiliary tripping unit as claimed in claim 15, wherein a projecting element is provided on a side of the rotatable body facing away from the bolt, as the at least one device to act on the auxiliary switch.

17. The auxiliary tripping unit as claimed in claim 7, wherein a holder, including a receptacle in which a spiral spring engages, is formed on, attached to or suspended on the rotatable body.

18. The auxiliary tripping unit as claimed in claim 7, wherein the moving body is rotatable about a stationary axis.

19. The auxiliary tripping unit as claimed in claim 18, wherein the at least one coupling device comprises a bolt which extends parallel to the rotation axis of the rotatable body.

20. The auxiliary tripping unit as claimed in claim 19, wherein a projecting element is provided on a side of the rotatable body facing away from the bolt, as the at least one device to act on the auxiliary switch.

* * * * *